US005807633A

United States Patent [19]

Tamaru et al.

[11] Patent Number: 5,807,633

[45] Date of Patent: Sep. 15, 1998

[54] POLYTETRAFLUOROETHYLENE COMPOSITE FIBER, COTTON-LIKE MATERIALS OBTAINED THEREFROM AND PROCESSES FOR PRODUCTION THEREOF

[75] Inventors: Shinji Tamaru; Katsutoshi Yamamoto; Shinichi Chaen; Jun Asano, all of Settsu, Japan

[73] Assignee: Daikin Industries, Ltd., Osaka, Japan

[21] Appl. No.: 809,844

[22] PCT Filed: Oct. 2, 1995

[86] PCT No.: PCT/JP95/02013

§ 371 Date: Apr. 1, 1997

§ 102(e) Date: Apr. 1, 1997

[87] PCT Pub. No.: WO96/10662

PCT Pub. Date: Apr. 11, 1996

[30] Foreign Application Priority Data

Oct. 4, 1994 [JP] Japan ..... 6-240429

[51] Int. Cl.[6] ..... D02G 3/00

[52] U.S. Cl. ..... 428/373; 428/400

[58] Field of Search ..... 428/370, 373, 428/374, 397, 375, 400

[56] References Cited

U.S. PATENT DOCUMENTS

| | | | |
|---|---|---|---|
| 3,001,265 | 9/1961 | Bundy | 428/373 |
| 3,003,223 | 10/1961 | Breen | 428/373 |
| 3,864,903 | 2/1975 | Maki | 264/DIG. 47 |
| 4,925,710 | 5/1990 | Buck et al. | 428/422 |
| 5,217,666 | 6/1993 | Tamaru et al. | 264/112 |
| 5,439,741 | 8/1995 | Gibbon et al. | 428/370 |
| 5,456,983 | 10/1995 | Sassa | 428/370 |
| 5,460,883 | 10/1995 | Barber | 428/373 |
| 5,562,986 | 10/1996 | Yamamoto et al. | 428/397 |
| 5,562,987 | 10/1996 | Shimizu | 428/364 |

FOREIGN PATENT DOCUMENTS

| | | |
|---|---|---|
| 52-81132 A | 7/1977 | Japan . |
| 59-163409 A | 9/1984 | Japan . |
| 2-91210 A | 3/1990 | Japan . |
| 6-501749 A | 2/1994 | Japan . |
| 7-229048 A | 8/1995 | Japan . |

*Primary Examiner*—Newton Edwards
*Attorney, Agent, or Firm*—Kubovcik & Kubovcik

[57] ABSTRACT

To provide a PTFE composite fiber having remarkably improved thermal bonding property, PTFE cotton-like materials which can be used for producing a non-woven fabric by thermal bonding method, processes for production thereof, a process for producing a split yarn, a process for producing a monofilament and a process for producing a multifilament having loop and/or branched structure.

A thermofusing resin layer is provided on the surface of the PTFE fiber. After lamination of the PTFE film and the thermofusing resin film, uniaxial stretching is carried out at a temperature between the melting points of the respective films.

7 Claims, 9 Drawing Sheets

POLYTETRAFLUOROETHYLENE COMPOSITE FIBER, COTTON-LIKE MATERIALS OBTAINED THEREFROM AND PROCESSES FOR PRODUCTION THEREOF

TECHNICAL FIELDS

The present invention relates to a polytetrafluoroethylene composite fiber, cotton-like materials obtained therefrom, processes for production thereof, and processes for producing a split yarn, a multifilament and a monofilament. The present invention particularly relates to the polytetrafluoroethylene composite fiber having remarkably improved thermal bonding property and the cotton-like materials obtained therefrom which are suitably used as materials for non-woven fabrics to be produceable by thermal bonding.

BACKGROUND ART

The polytetrafluoroethylene(PTFE) fibers have a low friction coefficient and are excellent in heat resistance, chemical resistance, electric insulation, hydrophobic property and air permeability. The PTFE fibers have been used, for example, as a bag filter by forming into a woven fabric or a felt-like non-woven fabric. However, in case of the felt-like non-woven fabric, there was a problem that falling of fibers occurs easily because there is no bonding between them. Once the PTFE fibers are sintered, no bonding occurs even if re-melting is carried out. The reason for that is that the bonding is difficult because a melt viscosity of PTFE is as high as from $10^{10}$ to $10^{13}$ poises.

Therefore, when the above-mentioned PTFE fibers once sintered are bonded in the molten state, there is no way other than applying a big pressure, and as a result, shape as a fiber becomes irregular.

From the reason mentioned above, the method of producing a non-woven fabric from the PTFE fibers once sintered is limited. Namely, there have been no way of producing a non-woven fabric other than simply intermingling the PTFE fibers by needle punching method or water jet needling method.

An object of the present invention is to provide the PTFE composite fiber having remarkably improved thermal bonding property, PTFE cotton-like materials which can be used to produce a non-woven fabric by thermal bonding, processes for production thereof, and processes for producing a split yarn, a monofilament and a multifilament having loop and/or branched structure.

DISCLOSURE OF THE INVENTION

The present invention relates to the polytetrafluoroethylene composite fiber having thermal bonding property and being provided with a layer of a thermofusing resin on at least a part of the surface of the polytetrafluoroethylene fiber.

The present invention also relates to the polytetrafluoroethylene composite fiber having thermal bonding property and shape of the polytetrafluoroethylene fiber is a monofilament.

The present invention also relates to the polytetrafluoroethylene composite fiber having thermal bonding property and the polytetrafluoroethylene fiber is a multifilament having loop and/or branched structure.

The present invention also relates to the polytetrafluoroethylene composite fiber having thermal bonding property and the polytetrafluoroethylene fiber is a split yarn.

The present invention also relates to the cotton-like materials having thermal bonding property and obtained from any one of the above-mentioned polytetrafluoroethylene composite fibers.

The present invention also relates to the process for producing the split yarn having thermal bonding property, characterized in that after forming a layer of a thermofusing resin having a melting point lower than that of a sintered polytetrafluoroethylene on at least a part of the surface of a polytetrafluoroethylene film, uniaxial stretching by at least 3 times is carried out at a temperature of not less than the melting point of the thermofusing resin and not more than the melting point of the sintered polytetrafluoroethylene, and the resulting uniaxially stretched film is further split.

The present invention also relates to the process for producing the multifilament having thermal bonding property and loop and/or branched structure, characterized in that after forming a layer of a thermofusing resin having a melting point lower than that of a sintered polytetrafluoroethylene on at least a part of the surface of a polytetrafluoroethylene film, uniaxial stretching by at least 3 times is carried out at a temperature of not less than the melting point of the thermofusing resin and not more than the melting point of the sintered polytetrafluoroethylene, and the resulting uniaxially stretched film is further split and network structure of the obtained split yarn is cut in the longitudinal direction.

The present invention also relates to the process for producing the polytetrafluoroethylene cotton-like materials having thermal bonding property, characterized in that after forming a layer of a thermofusing resin having a melting point lower than that of a sintered polytetrafluoroethylene on at least a part of the surface of a polytetrafluoroethylene film, uniaxial stretching by at least 3 times is carried out at a temperature of not less than the melting point of the thermofusing resin and not more than the melting point of the sintered polytetrafluoroethylene, and the resulting uniaxially stretched film is split, crosscut and then opened.

The present invention also relates to the process for producing the polytetrafluoroethylene cotton-like materials having thermal bonding property, characterized in that after forming a layer of a thermofusing resin having a melting point lower than that of a sintered polytetrafluoroethylene on at least a part of the surface of a polytetrafluoroethylene film, uniaxial stretching by at least 3 times is carried out at a temperature of not less than the melting point of the thermofusing resin and not more than the melting point of the sintered polytetrafluoroethylene, and the resulting uniaxially stretched film is split, and then the network structure of the split yarn is cut in the longitudinal direction, crosscut and then opened.

The present invention also relates to the process for producing the monofilament having thermal bonding property, characterized in that after forming a layer of a thermofusing resin having a melting point lower than that of a sintered polytetrafluoroethylene on at least a part of the surface of a polytetrafluoroethylene film, slitting and then uniaxial stretching by at least 3 times at a temperature of not less than the melting point of the thermofusing resin and not more than the melting point of the sintered polytetrafluoroethylene are carried out or after the layer of the thermofusing resin is formed, uniaxial stretching by at least 3 times at a temperature of not less than the melting point of the thermofusing resin and not more than the melting point of the sintered polytetrafluoroethylene and then slitting are carried out.

The present invention also relates to the process for producing the polytetrafluoroethylene cotton-like materials having thermal bonding property, characterized in that after forming a layer of a thermofusing resin having a melting point lower than that of a sintered polytetrafluoroethylene on at least a part of the surface of a polytetrafluoroethylene film, slitting and then uniaxial stretching by at least 3 times at a temperature of not less than the melting point of the thermofusing resin and not more than the melting point of the sintered polytetrafluoroethylene are carried out, or after the layer of the thermofusing resin is formed, uniaxial stretching by at least 3 times at a temperature of not less than the melting point of the thermofusing resin and not more than the melting point of the sintered polytetrafluoroethylene and then slitting are carried out, and that further endowing of crimps, crosscutting and opening are carried out.

The present invention also relates to the process for producing the polytetrafluoroethylene composite fiber having thermal bonding property, characterized in that after uniaxially stretched, the polytetrafluoroethylene film is laminated with a film of a thermofusing resin at a temperature of not less than the melting point of the thermofusing resin and not more than the melting point of the sintered polytetrafluoroethylene and further splitting or slitting is carried out.

The present invention also relates to the process for producing the polytetrafluoroethylene cotton-like materials having thermal bonding property, characterized in that after uniaxially stretched, the polytetrafluoroethylene film is laminated with a film of a thermofusing resin at a temperature of not less than the melting point of the thermofusing resin and not more than the melting point of the sintered polytetrafluoroethylene and further splitting or slitting and then crosscutting and opening are carried out.

In the present invention, it is preferable that immediately after the uniaxial stretching, reheating is carried out at a temperature of not less than the temperature for the uniaxial stretching.

BEST MODE FOR CARRYING OUT THE INVENTION

Figure 1:
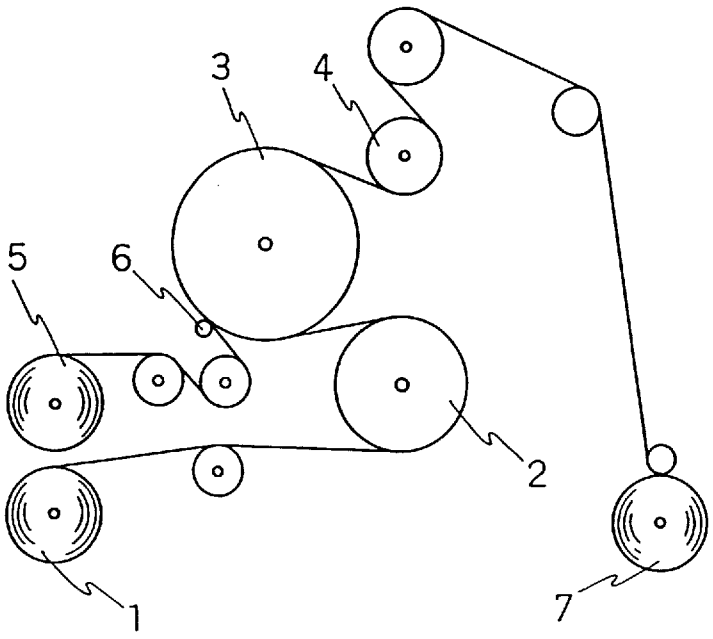
FIG. 1 is an explanatory view of the machine for laminating the PTFE film and thermofusing resin film in the present invention.

In the present invention, the PTFE fiber is a fiber obtained by splitting or slitting a PTFE film as mentioned below, and is a concept including a monofilament, split yarn and multifilament.

Namely, the above-mentioned split yarn is one obtained by uniaxially stretching and then splitting the PTFE film, has a network structure and is obtained immediately after splitting or in the form of a cord by bundling immediately after splitting.

Also the above-mentioned monofilament is one filament which is obtained by slitting and then uniaxially stretching the PTFE film or by uniaxially stretching and then slitting the PTFE film or one filament having loop and/or branched structure.

Further the above-mentioned multifilament is one comprising a plurality of the mentioned monofilaments and one comprising a plurality of filaments obtained by cutting the split yarn in the longitudinal direction and having loop and/or branched structure.

The length of a staple fiber among the abovementioned PTFE fibers is from 10 to 200 mm, preferably from 20 to 150 mm. When the fiber length is less than 10 mm, there is a tendency that falling of fibers occurs in a carding step, etc. and intermingling becomes poor. When more than 200 mm, there is a tendency that when the web is formed into a sliver, the web is not divided uniformly and carding becomes poor in a carding machine.

It is preferable that fineness of the filament making the above-mentioned PTFE film is less than 200 deniers. Though fibers having the fineness less than 2 deniers are present, it is difficult to measure the fineness thereof, and when more than 200 deniers, feeling of products obtained and intermingling become worse. The above-mentioned composite PTFE fiber is one provided with a layer of a thermofusing resin on at least a part of the surface thereof and having a remarkably improved thermal bonding property.

The above-mentioned thermofusing resin layer may be provided on at least a part of the surface of the PTFE film so that as mentioned hereinafter, the PTFE composite fibers are thermal-bonded to each other through the thermofusing resin layer. It is a matter of course that the thermofusing resin layer may be provided over the whole surface of the PTFE film.

The above-mentioned thermofusing resin of the present invention has a melting point of not more than the melting point of the sintered PTFE, that is, less than about 327° C., and a melt viscosity at least around 320° C. of not more than about $1\times10^6$ poises. Examples thereof may be, for instance, fluorine-containing thermofusing resins such as tetrafluoroethylene-perfluoro(alkyl vinyl ether) copolymer (PFA), tetrafluoroethylene-hexafluoropropylene copolymer (FEP), ethylene-tetrafluoroethylene copolymer (ETFE), ethylene-chlorotrifluoroethylene copolymer (ECTFE), polychlorotrifluoroethylene (PCTFE), polyvinylidene fluoride (PVdF) and polyvinyl fluoride (PVF); general-use resins such as polyethylene (PE), polypropylene (PP), polybutylene terephthalate (PBT) and polyethylene terephthalate (PET) and the like. Among them, the fluorine-containing thermofusing resins are preferable. PFA and FEP are more preferable from the viewpoint of good adhesion to PTFE when stretching at a temperature of not less than the melting point, and PFA is particularly preferable from the viewpoint of good heat resistance.

The melting point of the above-mentioned thermofusing resins is preferably from 100° C. to 320° C., particularly from 230° C. to 310° C. from a point that the thermofusing resins are not thermally decomposed when PTFE is stretched at relatively high temperature (not more than the melting point of PTFE).

The thickness of the layer comprising the abovementioned thermofusing resin is not more than 50 μm, preferably not more than 25 μm, particularly preferably not more than 12.5 μm. If the thickness is more than 50 μm, there is a tendency that a trouble such as entangling of the film on the needles of the needle blade rolls in the splitting step occurs.

The above-mentioned thermofusing resin layer may be provided on at least a part of the surface of the PTFE film, and may be one enabling the stretching to be conducted by heating at a temperature of not less than the melting point of the thermofusing resin in the uniaxial stretching step without causing peeling off of the thermofusing resin from the PTFE film. In Example, whether or not the layer comprising the thermofusing resin forms a continuous layer is observed by using a dye. However, in the present invention, the layer may not be continuous unless peeling occurs.

The thermal bonding property in the present invention is a property capable of thermally bonding the PTFE composite fiber provided with a layer comprising the thermofusing resin on the surface of the PTFE film, via the thermofusing resin. The thermal bonding property can be obtained when the resin is melted at a temperature lower than about 327° C. and has a melt viscosity of not more than about $1\times10^6$ poises at around 320° C.

The semi-sintered PTFE in the present invention is obtained by heat-treating the unsintered PTFE at a temperature between the melting point (about 327° C. ) of the sintered PTFE and the melting point (about 337° C. to about 347° C. ) of the unsintered PTFE.

The sintered PTFE in the present invention is one which is obtained by heat-treating the unsintered PTFE or the semi-sintered PTFE at a temperature of not less than the melting point of the unsintered PTFE.

The uniaxially stretched article in the present invention is obtained by the conventional methods such as stretching between the two rolls which have been heated to usually about 250° C. to about 320° C. and have different rotation speeds.

Figures 10A, 10B, 10C:
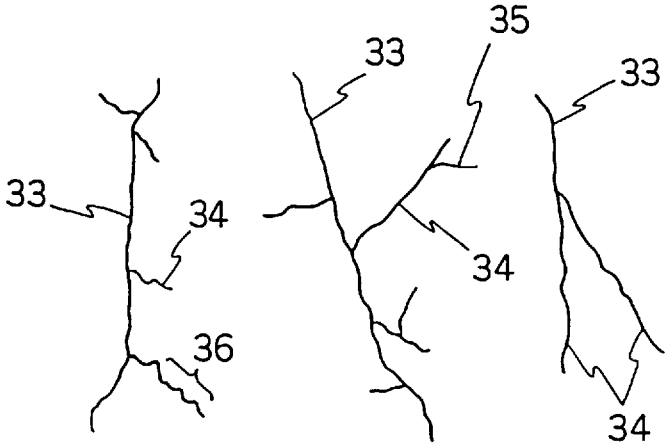
FIG. 10 is a diagrammatic view showing the loop and branched structures of the PTFE composite fibers contained in the PTFE cotton-like materials of the present invention.
Figure 10D:
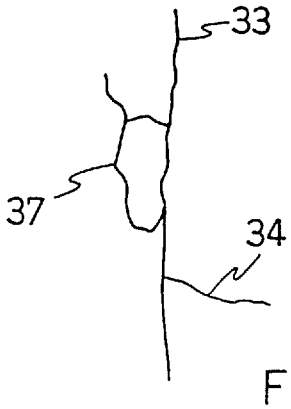

The branched structure and loop structure in the present invention can be illustrated as shown, for example, in FIG. 10. In FIG. 10, the fiber (a) has a branched structure comprising a fiber 33 and a plurality of branches 34 coming from the fiber 33. The fiber (b) is a fiber having a branch 34 and further a branch 35 coming from the branch 34. The fiber (c) is a fiber simply divided into two branches. The fiber (d) is a fiber having a loop 37. Those structures are only models of the fibers, and the fibers having the same structure are not found actually, which is one of the important features in the present invention. The number and the length of branches are not particularly limited, but the existence of such branches or loops is an important cause of enhancing intermingling property of the fibers. It is preferable that there is one branch or one loop, particularly at least two branches or at least two loops per 5 cm of the fiber.

The PTFE cotton-like materials of the present invention are those produced by, for example, giving crimps to the monofilaments, crosscutting to an optional fiber length and then collecting the cut fibers. Appearance thereof is like cotton(a group of fibers covering seeds).

The present invention also provides processes for producing, after forming the layer of the thermofusing resin on the surface of the PTFE film and stretching the film, (1) the split yarn by splitting,
(2) the multifilament having loop and/or branched structure by splitting the film and then cutting the network structure of the split yarn in the longitudinal direction,
(3) the PTFE cotton-like materials having thermal bonding property by splitting, crosscutting and then opening, and
(4) the PTFE cotton-like materials having thermal bonding property by splitting the film, cutting the network structure of the split yarn in the longitudinal direction and then crosscutting and opening.

The present invention also provides processes for producing, after forming the layer of the thermofusing resin on the surface of the PTFE film and slitting the film, (5) the PTFE composite fiber having thermal bonding property by stretching, and
(6) the PTFE cotton-like materials having thermal bonding property by stretching, giving crimps, crosscutting to optional fiber length and then opening.

The present invention further provides processes for producing, after stretching the PTFE film and then forming the thermofusing resin layer, (7) the PTFE composite fiber by splitting and then cutting or slitting the network structure in the longitudinal direction, and
(8) the PTFE cotton-like materials having thermal bonding property by further crosscutting the fiber and then opening.

As the PTFE in the present invention, there are, for example, those obtained through paste extrusion molding of PTFE fine powder (PTFE fine powder obtained by emulsion polymerization) or those obtained through compression molding of PTFE molding powder (PTFE powder obtained by suspension polymerization). The shape of the molded PTFE in the present invention includes such a form as film, tape, sheet and ribbon. A thickness thereof is 5 to 300 μm, preferably 5 to 150 μm in order to conduct a stable stretching. A PTFE film can be obtained by calendering the extrudate molded by paste extrusion of PTFE fine powder or cutting a compression-molded article produced from molding powder.

A thickness of the above-mentioned PTFE film is from 5 to 300 μm, preferably from 5 to 150 μm, more preferably from 5 to 100 μm. When the thickness is less than 5 μm, there is a restriction with respect to production step, and when more than 300 μm, there is a tendency that a stretching load at uniaxial stretching becomes too large and cost of the stretching machine becomes very high.

As a method of forming a thermofusing resin layer on the surface of the above-mentioned PTFE film, there is a method of laminating a thermofusing resin layer on the PTFE film or a method of coating and then drying a dispersion containing the thermofusing resin to form a film. In that case, as the thermofusing resin film to be laminated, the film produced from the above-mentioned thermofusing resin is used, and as the dispersion containing the thermofusing resin, there is used one which is produced by adding, for example, a surfactant to an aqueous dispersion having a particle size of from 0.1 to 0.5 μm and obtained through emulsion polymerization of, for example, tetrafluoroethylene-perfluoro (alkyl vinyl ether) copolymer (PFA) and tetrafluoroethylenehexafluoropropylene copolymer (FEP).

In order to form the layer by laminating the above-mentioned thermofusing resin film, the thermofusing resin may be thermally bonded at a temperature of not less than the melting point of the thermofusing resin film and not more than the melting point of the sintered PTFE film.

In order to form the layer by coating the above-mentioned dispersion, after spray coating, dip coating, etc. of the dispersion on the PTFE film, the dispersion may be dried at 20° to 110° C., preferably 50° to 90° C. for 10 to 120 minutes with an infrared ray lamp and hot blast stove and then further dried in the oven at a temperature higher than the melting point of the thermofusing resin by 10° to 20° C. for about 10 to about 30 minutes.

A thickness of the thermofusing resin layer is less than the thickness of the PTFE film and is not more than 25 μm, preferably not more than 10 μm, more preferably not more than 5 μm.

When the thickness of the thermofusing resin layer exceeds the above-mentioned range, there is a tendency that a load acting on an edge of the needle blade increases in the splitting and slitting steps, and as a result, the needle blade is damaged and the thermofusing resin layer provided on the PTFE film is wound around the needle blade.

The step of forming the thermofusing resin layer on the surface of the PTFE film is preferably carried out before the uniaxial stretching step from points that the leyer thickness can be made thinner and tearing property is enhanced.

In the present invention, the uniaxial stretching is carried out after the thermofusing resin layer is formed on at least a part of the surface of the PTFE film. It is preferable that the uniaxial stretching is carried out at a temperature of not less than the melting point of the thermofusing resin and not more than the melting point of the PTFE film.

The reason is that since the PTFE belongs to the group having smallest surface energy, if the stretching is carried out at a temperature of not more than the melting point of the thermofusing resin, interfacial failure occurs after the stretching due to adhesion failure at the interface which appears between the PTFE and the thermofusing resin by the stretching.

It is preferable that the stretching ratio in the above-mentioned uniaxial stretching is changed depending on the degree of sintering, and is at least 6 times, preferably not less than 10 times in the case of the semi-sintered PTFE, and at least 3 times, preferably not less than 3.5 times in the case of the sintered PTFE. This is because the orientation of the semi-sintered PTFE is necessary to be increased by stretching since the tearing property of the semi-sintered PTFE in the longitudinal direction is worse. Also in order to obtain fine fibers, it is desirable to stretch at as high ratio as possible, but the attainable stretching ratio is usually about 10 times in the case of the sintered PTFE, and about 30 times in the case of the semi-sintered PTFE.

Figure 9:
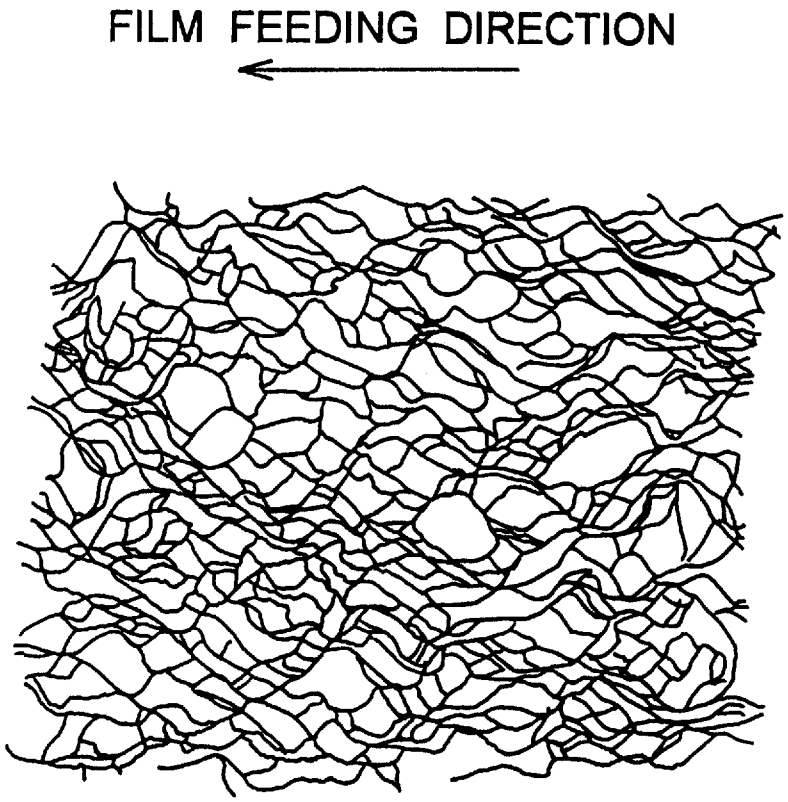
FIG. 9 is a diagrammatic view showing split yarns in the spreaded form of the present invention.

In the present invention, as means for splitting the uniaxially stretched PTFE film in the stretched direction to make network structure, a needle blade roll, preferably a pair of needle blade rolls are used. The network structure is such that the uniaxially stretched PTFE film split by the needle blades of the needle blade rolls is not split into separate fibers and when spread in the widthwise direction (a direction at a right angle to the film feeding direction) of the film after splitting, the film becomes net-like as shown in FIG. 9. In order to obtain such a network structure, the relation of the feed speed of the uniaxially stretched PTFE film and the rotation speed of the needle blade rolls, and the arrangement and the number of needles of the needle blade rolls may be properly selected, as mentioned hereinafter.

In the present invention, since PTFE maintains excellent uniaxial orientation even around the melting point thereof, even if a layer of a resin having poor uniaxial orientation such as FEP and PFA is provided on the surface of PTFE, it is possible to split easily by making the thickness of the layer less than a specific thickness and thermally bonding the layer to the PTFE film.

In the present invention, the split yarn can be crosscut, for example, by press-cutting with a cutter roller and anvil roller which are used for tow spinning or by crosscutting with a cutter such as a shearing press. A cut length is from 25 to 200 mm, preferably from 37.5 to 150 mm. When the cut length is too short, a percentage of dropped fibers of the obtained cotton-like materials increases and intermingling property becomes worse. When too long, there occurs an obstruction to processability of the cotton-like materials, for example, uniform dividing into webs. The split yarn is, after the crosscutting, opened by an opening machine or a carding machine to be formed into cotton-like materials.

The slitting in the present invention means that a wide and long film is cut continuously in the longitudinal direction to a ribbon form of as narrow width as possible. While the cutting can be carried out before or after the uniaxial stretching, in the present invention it is preferable to carry out the slitting before the stretching step from a point that fibers having small fineness are easy to be obtained. Namely, the slit width further decreases by stretching, and thus the fineness can be made smaller.

In the present invention, it is preferable that as shown in FIG. 10, the fiber 33 making the cotton-like materials obtained by the splitting has partly a "crimp" 36. The "crimp" also contributes to enhancement of intermingling property. The preferable number of crimps is 1 to 15/20 mm. According to the process of production of the present invention including the splitting step, crimps arise even if no specific crimping process is applied.

However, since the slit fibers are straight, even if they are crosscut to make cotton-like materials, it is hardly possible to treat them by a carding machine because they have no crimps. Therefore, the filament obtained from the slit fibers is necessary to be subjected to crimping step by passing it through heated gears or by other method.

An order of the above-mentioned steps of the present invention is such that after the layer of the thermofusing resin is formed on the surface of the PTFE film, the film is stretched and split to give a split yarn having a network structure, and then the obtained split yarn is cut in the longitudinal direction to give a multifilament having loop and/or branched structure, or the split yarn is crosscut and opened to give PTFE cotton-like materials having thermal bonding property.

Also, after the layer of the thermofusing resin is formed on the surface of the PTFE film, slitting and stretching are carried out to give PTFE composite fibers having thermal bonding property, and then after the stretching, the PTFE composite fibers are endowed with crimps, crosscut to an optional fiber length, and then opened to give PTFE cotton-like materials having thermal bonding property.

Further, after stretching of the PTFE film, the film is laminated with a thermofusing resin film and split and then, after the splitting, a network structure is cut or slit in the longitudinal direction to give PTFE composite fibers. Then by crosscutting and opening the fibers, PTFE cotton-like materials having thermal bonding property can be obtained.

Further, immediately after the above-mentioned stretching, by heat treating at a temperature of not less than a temperature for the stretching, shrinkage in the thermal bonding step can be prevented.

In order to produce a non-woven fabric by using the above-mentioned PTFE cotton-like materials obtained in the present invention, the PTFE cotton-like materials are formed into a web by using a carding machine, etc., and then the web is subjected to compression by using rolls (embossing rolls are preferable) heated to a temperature of not less than the melting point of the thermofusing resin or by other method to cause bonding of the fibers for bonding between them, thus making it possible to give a so-called thermally bonded non-woven fabric.

According to the above-mentioned method, there is no falling of fibers which occurs when producing the nonwoven fabric by a conventional needle punching method, etc.

The present invention is then explained based on Examples, but are not limited to them.

EXAMPLE 1

An unsintered film was obtained from PTFE fine powder (tradename: Polyflon F-104, melting point: 345° C., available from Daikin Industries, Ltd.) by paste extrusion molding and calendering, and then heat treatment was carried out under the conditions shown in Table 1 to give a heat-treated PTFE film.

With respect to physical properties of the heat-treated PTFE film, the melting point was determined according to a peak point of an endothermic curve measured with a differential scanning calorimeter (DSC) at a temperature raising rate of 10° C. /min, and the thickness was measured with a micrometer. The crystalline conversion was calculated by the following equation:

$$\text{Crystalline conversion}=(S_1-S_3)/(S_1-S_2)$$

wherein $S_1$ is the area of the endothermic curve of the unsintered PTFE in the above-mentioned DSC, $S_2$ is the area of the endothermic curve of the sintered PTFE and $S_3$ is the area of the endothermic curve of the semi-sintered PTFE.

The results are shown in Table 1.

The above-mentioned heat-treated PTFE film was laminated with a PFA film (available from Daikin Industries, Ltd., tradename: Neoflon PFA film, melting point: 305° C.) as the thermofusing resin film by means of an equipment shown in FIG. 1 under the conditions shown in Table 1 to give a laminated film.

In FIG. 1, numeral 1 represents a PTFE film after heat-treated, numeral 2 represents a preheating roll, numerals 3 and 4 represent heating rolls, numeral 5 represents a thermofusing resin film, numeral 6 represents a support roll and numeral 7 represents a laminated film. The films are laminated by the heating roll 3.

Figure 2:
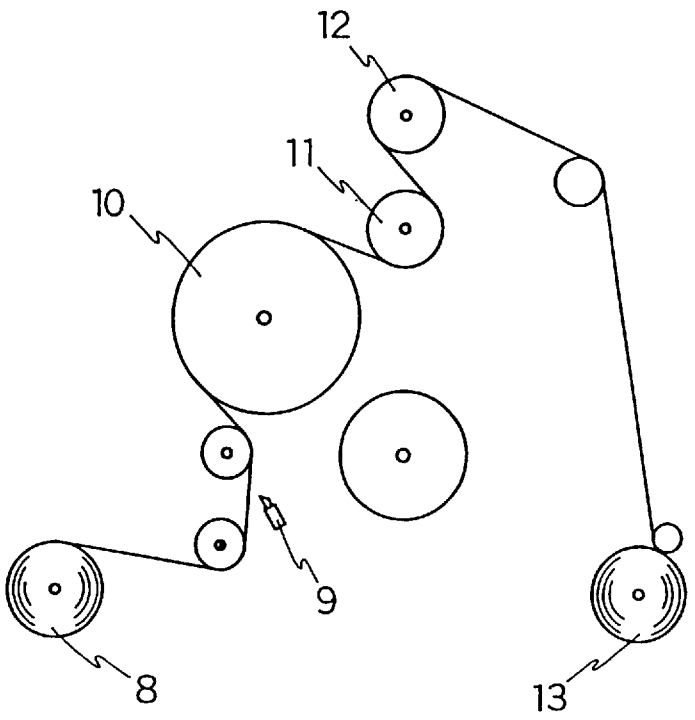
FIG. 2 is an explanatory view of the machine for uniaxially stretching the PTFE film provided with the thermofusing resin layer in the present invention.

Then the above-mentioned laminated film was uniaxially stretched under the stretching conditions shown in Table 2 by means of an equipment shown in FIG. 2 to give a uniaxially stretched film. A slit cutter knife 9 was not used, and a surface of the PTFE side of the laminated film 8 was made to contact with a surface of a heating roll 10.

In FIG. 2, numeral 8 represents a laminated film, numeral 9 represents a slit cutter knife (knife edges are set at intervals of 150 $\mu$m up to a width of about 200 mm), numerals 10 and 11 represent heating rolls, numeral 12 represents a cooling roll and numeral 13 represents a wound film. The laminated film 8 is uniaxially stretched by the heating roll 10 with heating.

The thickness of the uniaxially stretched film was measured in the same manner as above. The results are shown in Table 2.

An oily dye (available from Kabushiki Kaisha Sakura Kurepasu, A replenishing solution of a tradename: COLOR INK (registered trademark)) diluted nearly five times with a toluene solution was applied to the surface of the thermofusing resin layer of the uniaxially stretched film, and whether or not the dye penetrated into the PTFE film was judged with naked eyes. The results are shown in Table 2.

Figure 3:
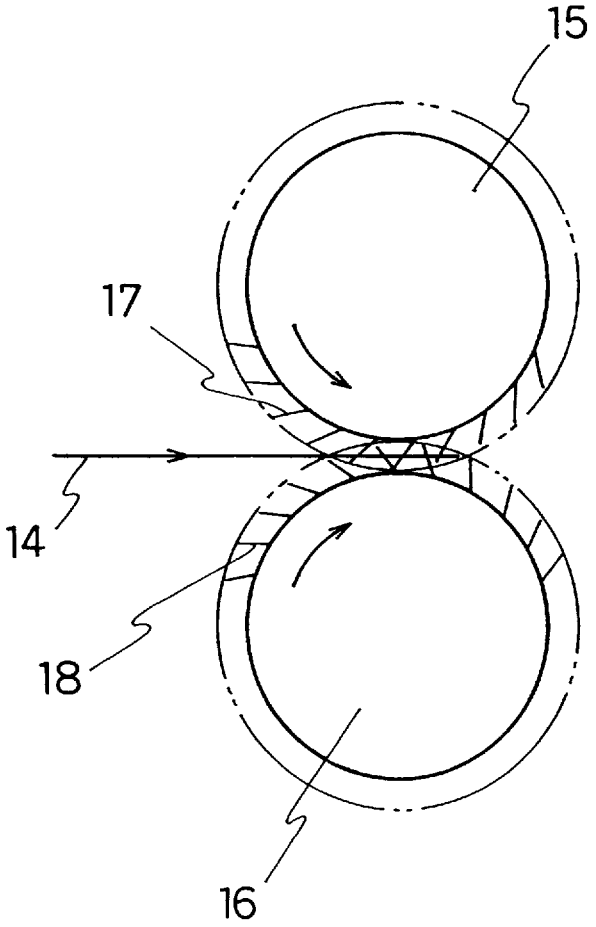
FIG. 3 is an explanatory view of the splitting machine used for the production process of the present invention.

The above-mentioned uniaxially stretched film was split by passing through a pair of upper and lower needle blade rolls as shown in FIG. 3. In that case, the film feed speed (v1) was 5 m/min, and the peripheral speed of the needle blade roll (v2) was 30 m/min. The speed ratio of v2/v1 was 6 times.

Figure 4:
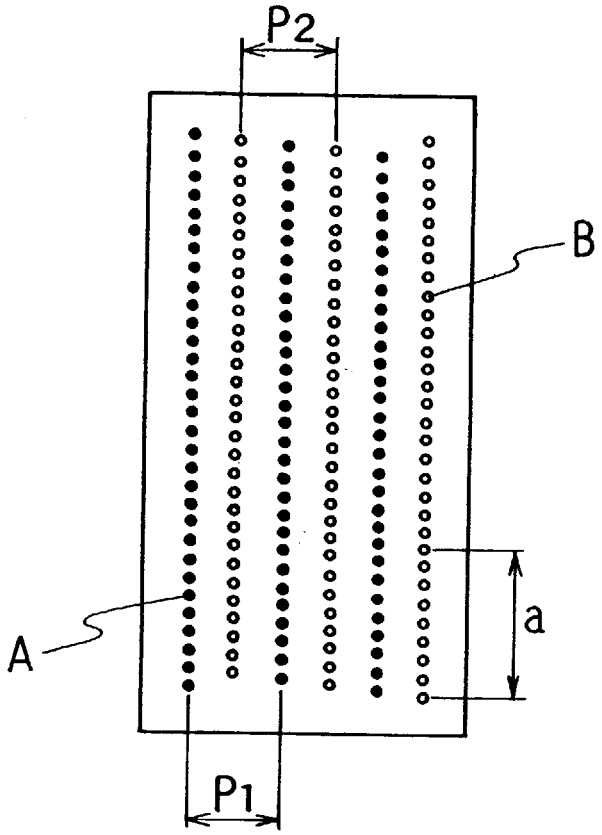
FIG. 4 is an explanatory view showing an example of arrangement of needle blades on the rolls of the splitting machine shown in FIG. 3.
Figure 5:
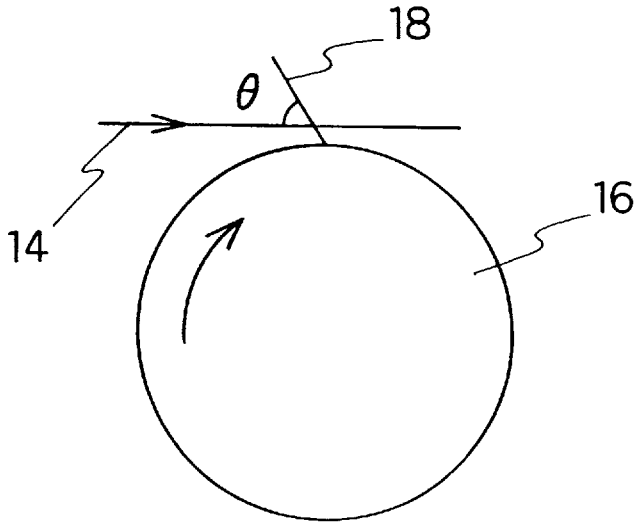
FIG. 5 is an explanatory view explaining an angle (θ) of a needle of the needle blade of the splitting machine shown in FIG. 3.

With respect to the shape of the needle blade rolls and the engagement of the blades of the upper and lower needle blade rolls are as mentioned below. When the film was passed at the same speed as a rotation of a pair of upper and lower needle blade rolls of FIG. 3, a punching pattern of the needles was obtained as shown in FIG. 4. In FIG. 3, numeral 14 represents a film, numeral represents an upper needle blade roll, numeral 16 represents a lower needle blade roll, and each of numerals 17 and 18 represents needle blades. In FIG. 4, A represents a needled hole of the upper needle blade roll and the pitch (P1) of the holes in the circumferential direction was 2.5 mm. Also, B represents a needled hole of the lower needle blade roll and the pitch (P2) thereof was 2.5 mm just like P1. The number "a" of needles in the longitudinal direction of the roll was 13 per 1 cm. Also as shown in FIG. 5, the angle of the needle to the film being fed between the rolls was so set as to be an acute angle. In FIG. 5, numerals 14, 16 and 18 represent the same parts as above.

With respect to the engagement of the upper and lower needle blade rolls, as it is clear from FIG. 4, those rolls were so set that the needles of the upper and lower needle blade rolls were arranged alternately in the circumferential direction of the rolls. The length of the needle blade rolls in the longitudinal direction was 250 mm, and the diameter was 50 mm at the ends thereof.

Figure 6:
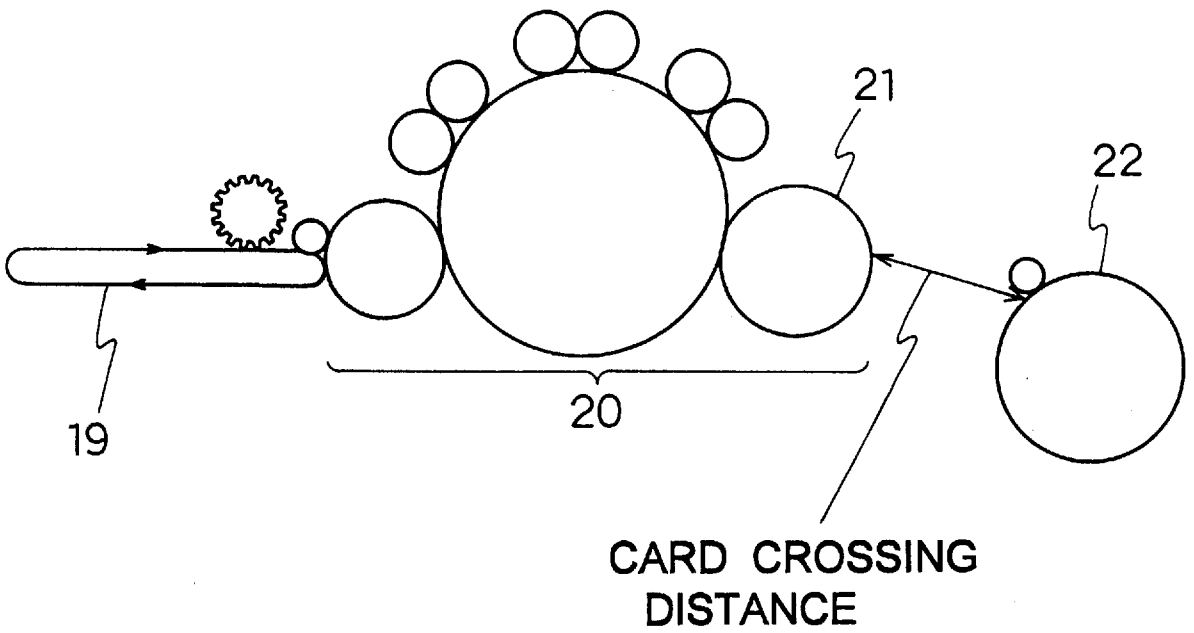
FIG. 6 is a diagrammatic view of a carding machine for producing a web from the cotton-like materials of the present invention.

The split uniaxially stretched film was crosscut to 70 mm, and passed through the carding machine (Model SC360-DR, available from Kabushiki Kaisha Daiwa Kiko) shown in FIG. 6 for opening to give a staple fiber. In FIG. 6, numeral 19 represents a fiber mass conveyer, numeral 20 represents a carding machine, numeral 21 represents a doffer and numeral 22 represents a drum.

With respect to the obtained staple fiber, the following tests were carried out.

Number of branches: A hundred pieces of fibers sampled at random from the above-mentioned staple fiber were placed on a paper and the number of branches thereof was measured with naked eyes (minimum number of branches per 5 cm).

Number of crimps: Measurement was made in accordance with the method of JIS L 1015 by means of an automatic crimp tester available from Kabushiki Kaisha Koa Shokai with a hundred pieces of fibers sampled at random(The crimps on the branch were not measured)(minimum number of crimps per 20 mm).

Fineness: A hundred pieces of fibers sampled at random were used to measure the fineness thereof with an electronic fineness measuring apparatus (available from Search Co., Ltd.) which utilizes a resonance of the fiber for measurement. The apparatus could measure the fineness of the fibers having the length of not less than 3 cm, and the fibers were selected irrespective of trunks or branches. But the fibers having, on the length of 3 cm, a large branch or many branches were excluded because they affect the measuring results. The apparatus is capable of measuring the fineness in the range of 2 to 70 deniers, and so the fibers having the fineness less than 2 deniers were excluded because measurement is difficult.

Fiber length: A hundred pieces of fibers were sampled at random and placed on a paper, and the longest length of the fiber made straight was assumed to be the fiber length and the number of fibers was measured.

Endothermic peak: Temperature corresponding to a peak on an endothermic curve in the temperature range of from 200° to 380° C. with DSC when about 10 mg of fibers was heated at a rate of 10° C./min.

The results are shown in Table 3.

Figure 7:
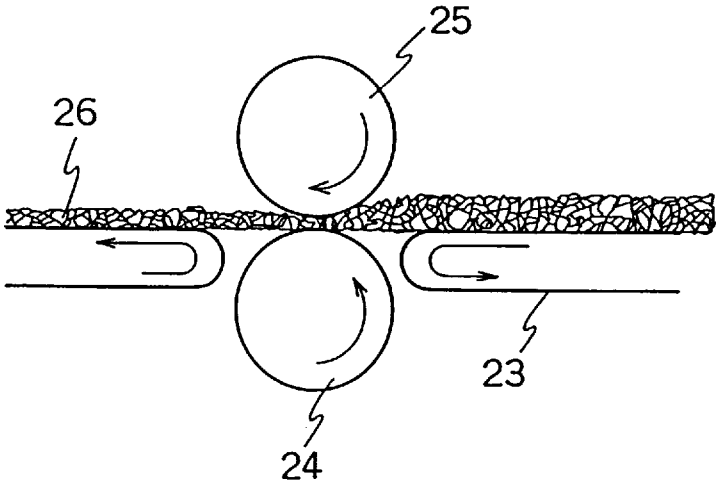
FIG. 7 is an explanatory view showing an example of the machine for producing the non-woven fabric from the PTFE cotton-like materials of the present invention.

Then the above-mentioned staple fiber was again passed through the carding machine shown in FIG. 6, and the web was removed from the doffer and folded back at a width of about 30 cm with a lattice (a conveyer for feeding the web) and a cross lapper (an equipment for piling the webs to adjust a weight per unit area) to give a web having an average weight per unit area of 250 g/m$^2$. Further the obtained web was passed through the heated nip rolls shown in FIG. 7 under the conditions shown in Table 4 to give a non-woven fabric. In FIG. 7, numeral 23 represents a web feeding belt, numeral 24 represents a heating roll, numeral 25 represents an embossing roll and numeral 26 represents a thermally bonded sheet.

With respect to the obtained non-woven fabric, the following tests were carried out.

Weight per unit area: Ten 10 cm squares were cut off at intervals of 20 cm from the center of the produced non-woven fabric, and the weight of them was measured. The measured weight was converted based on 1 m$^2$. Both of the measured values and the average values were rounded to tens.

Thickness: The thickness of the center of ten pieces of the non-woven fabrics sampled for measurement of the weight per unit area was measured by a PEACOCK (registered trademark) dial thickness meter (available from OZAKI MFG CO., LTD.). The measured values were rounded to tens.

Strength in the longitudinal direction:

Five non-woven fabrics were selected alternately from the fabrics sampled for the above measurement of the weight per unit area. The center of one of the five fabrics was cut to a width of 3 cm in the same direction as the fabric feeding direction in the production step. When the fabric was torn by applying tension at rate of 200 mm/min, a load at break was rounded to the first decimal place. In Examples 5 and 6, the load was rounded to the second decimal place.

Strength in the transverse direction:

The remaining fabrics sampled for measuring the strength in the longitudinal direction were cut to a width of 3 cm in the direction vertical to the fabric feeding direction in the production thereof. The measurement was carried out in the same manner as in measurement in the longitudinal direction. In Examples 5 and 6, the load was rounded to the second decimal place.

Pressure loss: Ten sampled fabrics used for the measurement of the weight per unit area were put in a ventilation tube having a diameter of 75 mm, and air was flowed through the tube at a rate of 0.5 cm/sec. Then a pressure differential before and after the sample was assumed to be a pressure loss (values of ten samples measured).

Air permeability: With respect to ten sampled fabrics used for the measurement of the weight per unit area, a flow of air passed through the sample was measured with a Frazier type air permeability tester at the time when the pressure loss was 12.7 mm $H_2O$. Both of the measured values and the average values were rounded to tens.

The results are shown in Table 5.

EXAMPLES 2 AND 3

A non-woven fabric was obtained in the same manner as in Example 1 except that the conditions shown in Tables 1, 2 and 4 were employed. In Example 3, the film feed speed v1 was 5 m/min, the peripheral speed of the needle blade roll v2 was 15 m/min and v2/v1 speed ratio was 3.

Measurement of physical properties and the tests were carried out in the same manner as in Example 1.

The results are shown in Tables 1 to 5.

EXAMPLE 4

A non-woven fabric was obtained in the same manner as in Example 3 except that after the uniaxial stretching, reheat treatment was carried out by means of an equipment shown in FIG. 1 under the conditions that the peripheral speed of the preheating roll was 0.10 m/min, the temperature of the heating roll 3 was 360° C., its peripheral speed was 0.11 m/min and the peripheral speed of the heating roll 4 was 0.11 m/min. The thickness of the film after the reheat treatment was 13 $\mu$m.

Measurement of physical properties and tests were carried out in the same manner as in Example 1.

The results are shown in Tables 1 to 5.

EXAMPLE 5

A laminated film was obtained in the same manner as in Example 1 except that the conditions of Table 1 were employed, uniaxial stretching was carried out in the same manner as in Example 1 except that a slit cutter knife was used in an equipment shown in FIG. 2 and the conditions of Table 2 were employed, and then reheat treatment was carried out in the same manner as in Example 4, to give a multifilament made of monofilaments having fineness of about 20 deniers. At the time of the uniaxial stretching, the laminated film 8 was so set that the surface of the PTFE film contacts with the surface of the heating roll 10 shown in FIG. 2.

The obtained multifilament was endowed with crimps at a rate of 5 crimps/20 cm by a gear type crimping machine heated to 280° C., and crosscut by a cutter to obtain the fiber length of 75 mm, and thus a staple fiber was obtained.

Then the obtained staple fiber was passed through the carding machine shown in FIG. 6 and the shortest distance between the doffer and the lattice was approximated to 5 cm to feed the web. The web was then folded back to a width of about 30 cm with a cross lapper to give a web having a weight per unit area of about 300 g/m$^2$.

Figure 8:
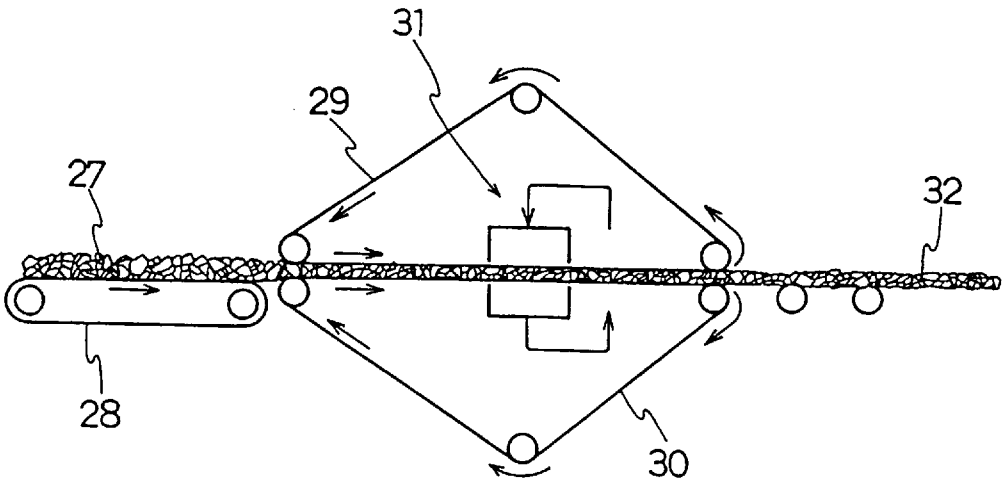
FIG. 8 is an explanatory view showing an another example of the machine for producing the non-woven fabric from the PTFE cotton-like materials of the present invention.

Further the obtained web was thermally bonded with hot air by an equipment shown in FIG. 8. In FIG. 8, numeral 27 represents a web, numeral 28 represents a lattice (feeding of a web), numeral 29 represents an upper support belt (SUS 10 metal mesh belt), numeral 30 represents a lower support belt (SUS 10 metal mesh belt), numeral 31 represents a hot air generating and recirculating equipment and numeral 32 represents a bonded web. Namely, the web was transferred from the lattice onto the metal net and further supported with a metal net from the above, and then passed through a duct where 300° C. hot air was recirculating, for 10 seconds to bond the contacting fibers. Thus the non-woven fabric was obtained by the thermal bonding method. The thickness of the film after the reheat treatment was 20 $\mu$m.

Measurement of physical properties and tests were carried out in the same manner as in Example 1. In Example 5, the length of all the fibers was 75 mm.

The results are shown in Tables 1 to 3 and 5.

EXAMPLE 6

After uniaxial stretching of the unsintered film obtained in Example 1 under the conditions shown in Table 2, heat treatment was carried out under the conditions shown in Table 1 and a PTFE dispersion (available from Daikin Industries, Ltd., tradename: Neoflon FEP Dispersion ND-4) was coated on one surface of the PTFE film by a kiss roll. Then the film was passed through a drying oven at 120° C. for five minutes and further through a heating oven at 300° C. for five minutes to give a coated film having a 10 μm thick FEP layer.

Then uniaxial stretching of the coated film was carried out in the same manner as in Example 1 except that the conditions shown in Table 2 were employed, and then reheat treatment was carried out in the same manner as in Example 4 to give a uniaxially stretched film. The thickness of the film after the reheat treatment was 12 μm.

A staple fiber was produced from the obtained uniaxially stretched film in the same manner as in Example 1.

A non-woven fabric was produced from the obtained staple fiber through the web in the same manner as in Example 5.

Measurement of physical properties and tests were carried out in the same manner as in Example 1.

The results are shown in Tables 1 to 3.

TABLE 1

| | Ex. 1 | Ex. 2 | Ex. 3 | Ex. 4 | Ex. 5 | Ex. 6 |
|---|---|---|---|---|---|---|
| PTFE film | | | | | | |
| Conditions of heat treatment | | | | | | |
| Temperature (°C.) | 360 | 360 | 337 | 337 | 337 | 337 |
| Time (seconds) | 60 | 60 | 50 | 50 | 50 | 50 |
| Kind of heating bath | Molten salt | Molten salt | Molten salt | Molten salt | Molten salt | Molten salt |
| Physical properties after heat treatment | | | | | | |
| Melting point (°C.) | 327 | 327 | 345 | 345 | 345 | 345 |
| Thickness (μm) | 60 | 60 | 60 | 60 | 125 | 60 |
| Crystalline conversion | 1.0 | 1.0 | 0.4 | 0.4 | 0.38 | 0.4 |
| Thermofusing resin layer | | | | | | |
| Kind | PFA | FEP | PFA | PFA | FEP | FEP dispersion |
| Thickness (μm) | 12.5 | 12.5 | 12.5 | 12.5 | 12.5 | 10.0 |
| Melting point (°C.) | 305 | 270 | 305 | 305 | 270 | 260 |
| Conditions of lamination | | | | | | |
| Preheating roll | | | | | | |
| Roll diameter (mm) | 250 | 250 | 250 | 250 | 250 | — |
| Temperature (°C.) | 300 | 250 | 300 | 300 | 280 | — |
| Peripheral speed (m/min) | 0.20 | 0.20 | 0.20 | 0.20 | 0.20 | — |
| Heating roll 3 | | | | | | |
| Roll diameter (mm) | 350 | 350 | 350 | 350 | 350 | — |
| Temperature (°C.) | 320 | 300 | 320 | 320 | 300 | — |
| Peripheral speed (m/min) | 0.21 | 0.21 | 0.21 | 0.21 | 0.21 | — |
| Heating roll 4 | | | | | | |
| Roll diameter (mm) | 200 | 200 | 200 | 200 | 200 | — |
| Temperature (°C.) | 280 | 250 | 280 | 280 | 250 | — |
| Peripheral speed (m/min) | 0.21 | 0.21 | 0.21 | 0.21 | 0.21 | — |

TABLE 2

| | Ex. 1 | Ex. 2 | Ex. 3 | Ex. 4 | Ex. 5 | Ex. 6 |
|---|---|---|---|---|---|---|
| Conditions of stretching | | | | | | |
| Unwinding speed (m/min) | 0.2 | 0.2 | 0.2 | 0.2 | 0.1 | 0.2 |
| Use of a slit cutter knife | Not used | Not used | Not used | Not used | Used | Not used |
| Heating roll 10 | | | | | | |
| Roll diameter (mm) | 350 | 350 | 350 | 350 | 350 | 350 |
| Temperature (°C.) | 320 | 300 | 320 | 320 | 300 | 300 |
| Peripheral speed (m/min) | 0.5 | 0.5 | 1.5 | 1.5 | 0.7 | 1.5 |
| Heating roll 11 | | | | | | |
| Roll diameter (mm) | 200 | 200 | 200 | 200 | 200 | 200 |
| Temperature (°C.) | 280 | 250 | 280 | 280 | 250 | 250 |
| Peripheral speed (m/min) | 1 | 1 | 3 | 3 | 1.5 | 3 |
| Stretching ratio (Times) | 5 | 5 | 15 | 15 | 15 | 15 |
| Cooling roll | | | | | | |
| Roll diameter (mm) | 200 | 200 | 200 | 200 | 200 | 200 |
| Temperature (°C.) | 10–30 | 10–30 | 10–30 | 10–30 | 10–30 | 10–30 |
| Peripheral speed (m/min) | 1 | 1 | 3 | 3 | 1.5 | 3 |
| Film thickness after stretching (μm) | 25 | 25 | 17 | 17 | 25 | 16 |

TABLE 2-continued

| | Ex. 1 | Ex. 2 | Ex. 3 | Ex. 4 | Ex. 5 | Ex. 6 |
|---|---|---|---|---|---|---|
| Penetration of dye solution | None | None | None | None | None | None |

TABLE 3

| | Ex. 1 | Ex. 2 | Ex. 3 | Ex. 4 | Ex. 5 | Ex. 6 |
|---|---|---|---|---|---|---|
| Physical properties of staple fiber | | | | | | |
| Number of branches (per 5 cm) | 1 | 1 | 1 | 1 | 0 | 1 |
| Number of crimps (/20 mm) | 1 | 1 | 1 | 1 | 5 | 1 |
| Fineness (deniers) | 2–45 | 2–45 | 2–45 | 2–35 | 20 | 2–35 |
| Fiber length | | | | | | |
| not less than 30 mm and less than 50 mm (piece) | 8 | 12 | 16 | 15 | — | 10 |
| not less than 50 mm and less than 85 mm (piece) | 88 | 82 | 79 | 75 | — | 81 |
| not less than 85 mm and less than 100 mm (piece) | 4 | 6 | 5 | 10 | — | 9 |
| Endothermic peak | | | | | | |
| (°C.) | 327 | 327 | 345 | 327 | 327 | 327 |
| (°C.) | 305 | 270 | 305 | 305 | 270 | 240 |

TABLE 4

| | Ex. 1 | Ex. 2 | Ex. 3 | Ex. 4 |
|---|---|---|---|---|
| Conditions of nip rolls | | | | |
| Heating roll (Induction heating roll) | | | | |
| Diameter (mm) | 200 | 200 | 200 | 200 |
| Temperature (°C.) | 320 | 290 | 320 | 320 |
| Peripheral speed (m/min) | 0.5 | 0.5 | 0.5 | 0.5 |
| Support roll (Embossing roll) | | | | |
| Diameter (mm) | 200 | 200 | 200 | 200 |
| Temperature (°C.) | 200 | 200 | 200 | 200 |
| Distance between heating roll and support roll (mm) | 200 | 200 | 200 | 200 |

TABLE 5

| | Ex. 1 | Ex. 2 | Ex. 3 | Ex. 4 | Ex. 5 | Ex. 6 |
|---|---|---|---|---|---|---|
| Physical properties of non-woven fabric | | | | | | |
| Weight per unit area (g/m$^2$) | | | | | | |
| Average value | 250 | 250 | 150 | 150 | 290 | 300 |
| Minimum value | 220 | 220 | 130 | 130 | 280 | 280 |
| Maximum value | 280 | 270 | 180 | 180 | 310 | 310 |
| Thickness ($\mu$m) | | | | | | |
| Average value | 220 | 210 | 210 | 210 | 350 | 370 |
| Minimum value | 210 | 200 | 190 | 200 | 320 | 340 |
| Maximum value | 230 | 220 | 220 | 230 | 380 | 400 |
| Strength in the longitudinal direction (kg/cm) | | | | | | |
| Average value | 1.3 | 1.2 | 1.0 | 1.1 | 0.17 | 0.14 |
| Minimum value | 1.0 | 1.1 | 0.9 | 0.8 | 0.15 | 0.11 |
| Maximum value | 1.9 | 1.7 | 1.1 | 1.5 | 0.19 | 0.17 |
| Strength in the transverse direction (kg/cm) | | | | | | |
| Average value | 0.8 | 0.7 | 0.7 | 0.7 | 0.13 | 0.11 |
| Minimum value | 0.5 | 0.5 | 0.5 | 0.6 | 0.12 | 0.90 |
| Maximum value | 1.2 | 1.0 | 0.9 | 0.8 | 0.15 | 0.13 |
| Pressure loss (mmH2O) | | | | | | |
| Average value | 3–4 | 3–4 | 5 | 4 | — | — |
| Minimum value | 3 | 3 | 4 | 3 | — | — |
| Maximum value | 4 | 4 | 7 | 5 | — | — |
| Air permeability (cm$^3$/cm$^2$/sec) | | | | | | |
| Average value | — | — | — | — | 160 | 160 |
| Minimum value | — | — | — | — | 130 | 140 |
| Maximum value | — | — | — | — | 200 | 190 |

EXAMPLE 7

The split yarn obtained in Example 1 was passed two times through comb-like 0.5 mm wide blades provided at intervals of 2 mm to cut a network and give a bundle of multifilaments having loop and/or branched structure. The bundle was subdivided to about 400 deniers and a twist yarn was produced from three yarns by twisting at a rate of 5 times/25 mm by using a twist tester. As a result of having passed the twist yarn in an oven at 320° C. for five seconds, there could be obtained a finished yarn which could not be untwisted again and had a fluff made by thermal bonding between the fibers.

EXAMPLE 8

The bundle of multifilaments obtained in Example 5 was subdivided to about 300 deniers, and a twist yarn was produced in the same manner as in Example 7. As a result of having passed the twist yarn in an oven at 300° C. for five seconds, there could be obtained a finished yarn which could not be untwisted again and had no fluff made by thermal bonding between the fibers.

EXAMPLE 9

Cotton-like materials were obtained in the same manner as in Example 1 except that the film after the stretching was passed through an oven at 340° C. for 15 seconds.

One end of the fibers obtained in Examples 1 and 9 was fixed on a glass plate with an adhesive to measure the length of the fiber (L1) and an another glass plate was placed thereon. Then after holding in the oven at temperatures of 200° C., 250° C. and 300° C. for 30 minutes, the fiber length (L2) was again measured to obtain shrinkage of the fiber. The shrinkage of five fibers sampled were measured by the equation [(L1−L2)/L1]×100 (%) and an average value of the obtained shrinkages was calculated.

The results are shown in Table 6.

TABLE 6

| | 200° C. | 250° C. | 300° C. |
|---|---|---|---|
| Shrinkage of the fiber obtained in Example 1 | 3.5% | 10.9% | 16.2% |
| Shrinkage of the fiber obtained in Example 9 | 2.1% | 6.1% | 8.1% |

Comparative Example 1

The film having a 60 μm thick PFA film layer before splitting was split in the same manner as in Example 1. However, there occurred in the splitting step a trouble that the film is wound around the needle of the needle blade roll.

Comparative Example 2

The same procedures as in Example 2 were tried to be repeated except that the temperature of the heating roll 10 was 260° C. in the stretching step, but fine powders and fiber trashes were produced in the splitting step.

Comparative Example 3

The same procedures as in Example 3 were tried to be repeated except that the temperature of the heating roll 10 was 280° C. in the stretching step, but in the splitting step, the film was wound around the needles of the needle blade roll and fine powders were produced.

Comparative Example 4

The same procedures as in Example 5 were tried to be repeated except that the temperature of the heating roll 10 was 250° C. in the stretching step and the reheat treatment step was omitted, but in the stretching step, the FEP layer begun to be peeled off.

INDUSTRIAL APPLICABILITY

As it is clear from the above-mentioned results, the PTFE composite fiber of the present invention is excellent in intermingling property and has remarkably improved thermal bonding property.

Also the PTFE cotton-like materials of the present invention are excellent in thermal bonding property and are used suitably for a non-woven fabric produced by thermal bonding method.

Also the present invention relates to the process for producing the split yarn and can provide the process for producing the split yarn being excellent in intermingling property and thermal bonding property.

Also the present invention relates to the process for producing the multifilament having loop and/or branched structure and can provide the process for producing the multifilament being excellent in intermingling property and thermal bonding property.

Further the present invention relates to the process for producing the monofilament and can provide the process for producing the monofilament having excellent thermal bonding property.

Further the present invention relates to the process for producing the PTFE cotton-like materials and can provide the process for producing the PTFE cotton-like materials for a non-woven fabric which is excellent in thermal bonding property and produced by the thermal bonding method.

Further the present invention relates to the process for producing the PTFE composite fiber and can provide the process for producing the PTFE composite fiber having excellent thermal bonding property.

Further in the present invention, by heat-treating at a temperature of not less than a temperature for the above-mentioned uniaxial stretching immediately after the uniaxial stretching, there can be obtained the PTFE composite fiber having small heat shrinkage, the PTFE cotton-like materials, split yarn and monofilament which are produced therefrom and the multifilament having loop and/or branched structure.

We claim:

1. A polytetrafluoroethylene composite fiber having thermal bonding property, which comprises a polytetrafluoroethylene fiber and a layer of a thermofusing resin provided on a part of a surface of the polytetrafluoroethylene fiber.

2. The polytetrafluoroethylene composite fiber of claim 1 having thermal bonding property, wherein said thermofusing resin is tetrafluoroethylene-perfluoro(alkyl vinyl ether) copolymer tetrafluoroethylene-hexafluoropropylene copolymer or mixtures thereof.

3. The polytetrafluoroethylene composite fiber of claim 1 having thermal bonding property, wherein said polytetrafluoroethylene fiber is a uniaxially stretched semi-sintered polytetrafluoroethylene.

4. The polytetrafluoroethylene composite fiber of claim 1 having thermal bonding property, wherein said polytetrafluoroethylene fiber is a uniaxially stretched sintered polytetrafluoroethylene.

5. The polytetrafluoroethylene composite fiber of claim 1 having thermal bonding property, wherein a shape of said polytetrafluoroethylene fiber is a monofilament.

6. The polytetrafluoroethylene composite fiber of claim 1 having thermal bonding property, wherein said polytetrafluoroethylene fiber is a multifilament having loop structure, branched structure or both loop and branched structure.

7. The polytetrafluoroethylene composite fiber of claim 1 having thermal bonding property, wherein said polytetrafluoroethylene fiber is a split split yarn.

* * * * *